US011823637B2

(12) United States Patent
Lin et al.

(10) Patent No.: US 11,823,637 B2
(45) Date of Patent: Nov. 21, 2023

(54) TIMING CONTROL CIRCUIT AND OPERATION METHOD THEREOF

(71) Applicant: Novatek Microelectronics Corp., Hsinchu (TW)

(72) Inventors: Yi-Tsung Lin, Yilan County (TW); Yen-Tao Liao, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 17/564,253

(22) Filed: Dec. 29, 2021

(65) Prior Publication Data

US 2023/0206872 A1 Jun. 29, 2023

(51) Int. Cl.
*G09G 3/36* (2006.01)

(52) U.S. Cl.
CPC ..... *G09G 3/3614* (2013.01); *G09G 3/3688* (2013.01); *G09G 2310/08* (2013.01)

(58) Field of Classification Search
CPC .. G09G 3/3614; G09G 3/3648; G09G 3/3688; G09G 3/3696
See application file for complete search history.

(56) References Cited

U.S. PATENT DOCUMENTS 8,698,850 B2 4/2014 Kentaro et al.
8,994,631 B2 3/2015 Chun et al.
10,902,766 B1 * 1/2021 Wu ..... G09G 3/2092
11,398,202 B2 7/2022 Tsuchi et al.
2003/0189563 A1 * 10/2003 Sato ..... G09G 3/3659 345/209
2008/0001889 A1 1/2008 Chun et al.
2010/0277509 A1 * 11/2010 Lu ..... G09G 3/344 345/107
2011/0221760 A1 9/2011 Kentaro et al.
2014/0375621 A1 * 12/2014 Lee ..... G09G 3/003 345/212

(Continued)

FOREIGN PATENT DOCUMENTS

CN 101097310 7/2010
CN 102265327 11/2011

(Continued)

OTHER PUBLICATIONS

CN-111261075-A Jun. 2020 Xie J G09G3/006 Englishmachine translation (Year: 2020).*

(Continued)

*Primary Examiner* — Van N Chow
(74) *Attorney, Agent, or Firm* — JCIPRNET

(57) ABSTRACT

A timing control circuit is provided to control a data voltage outputted to a pixel array of a display panel during a frame period to perform a polarity reversal every N scan lines, where N is a positive integer. The timing control circuit includes a receiver and an adjustment circuit. The receiver is configured to sequentially receive first display data and second display data for one data line of the display panel. The adjustment circuit is coupled to the receiver to adjust at least one of gray information of the second display data and charging time of the second display data according to a voltage polarity of the first display data and a voltage polarity of the second display data. A corresponding operation method of the timing control circuit is also provided.

12 Claims, 9 Drawing Sheets

(56) References Cited

U.S. PATENT DOCUMENTS

| | | | | |
|---|---|---|---|---|
| 2015/0022747 | A1 | 1/2015 | Hong et al. | |
| 2018/0114478 | A1 | 4/2018 | Tien et al. | |
| 2018/0182322 | A1 | 6/2018 | Liu | |
| 2019/0272784 | A1* | 9/2019 | Huang | G09G 3/3648 |
| 2021/0035520 | A1 | 2/2021 | Tsuchi et al. | |
| 2021/0295788 | A1* | 9/2021 | Kuo | G09G 3/3413 |

FOREIGN PATENT DOCUMENTS

| | | |
|---|---|---|
| CN | 102024438 | 10/2012 |
| CN | 112309342 | 2/2021 |

OTHER PUBLICATIONS

"Office Action of Taiwan Counterpart Application", dated Jan. 17, 2023, p. 1-p. 4.

* cited by examiner

TIMING CONTROL CIRCUIT AND OPERATION METHOD THEREOF

BACKGROUND

Technical Field

The disclosure relates to a timing control circuit, and more particularly, to a technical means for adjusting an output signal according to a voltage polarity of display data.

Description of Related Art

When the panel displays a static image for a long time, liquid crystals will maintain a specific twisted state. When the image changes, problems such as crosstalk, burn-in, and color shift will often occur. The reasons include the varying degrees of aging of the liquid crystals and the rigidity of the liquid crystals caused by maintaining the specific twisted state for a long time. In order to solve such issue, the existing practice is to periodically change the polarity of the liquid crystal voltage, which is referred to as the polarity reversal. The polarity reversal may be divided into a frame inversion, a column inversion, a line inversion (or referred to as a row inversion), and a dot inversion. Considering the power consumption and display effect, the row inversion of polarity is the most commonly adopted. However, when performing the row inversion of polarity, due to the difference in charging rate and charging saturation between two pixel rows with different polarities of the data voltage, the twisting speed and twisting angle of the liquid crystals are different, resulting in a difference in brightness. At this time, dark lines will appear on the display screen.

FIG. 1 is a schematic view of a waveform of a row inversion performed on a polarity of a data voltage. FIG. 2 is a schematic view of dark lines appearing on a display screen. Referring to FIG. 1, a vertical axis denotes a data voltage V, and a horizontal axis denotes time t. The data voltage V at different time points in FIG. 1 may be regarded as the data voltage received by multiple pixels in the same row of a display panel (as shown in FIG. 2) through the same data channel at a corresponding scanning timing. In FIG. 1, curves C1 and C2 respectively denote the data voltage that varies with time in an ideal state and an actual state. It is assumed that column polarity inversion is performed every four pixel rows. In the actual state, when the polarity of the current data voltage is opposite to the polarity of the previous data voltage, the pixel will not be charged enough (referring to where arrows 101 to 104 point, there is a gap between the curve C2 and the curve C1). Therefore, the dark lines as shown in FIG. 2 (for example, corresponding to positions of pixel rows SL5, SL9, and SL13) are generated. This problem will be more serious when the rotation speed of the liquid crystals is not fast enough, and the required number of frames per second is high. In addition, the dark lines of technical drawings (displayed with the same gray scale in a large area) will be more obvious than those of natural drawings.

Therefore, a solution is required to avoid the issue of the dark lines on the display screen when performing the polarity reversal.

SUMMARY

The disclosure provides a timing control circuit, which may adjust an output signal thereof according to a voltage polarity of display data, thereby avoiding an issue of dark lines appearing on a display screen when a polarity reversal is performed.

A timing control circuit in the disclosure is configured to control a data voltage outputted to a pixel array of a display panel during a frame period to perform a polarity reversal every N scan lines, where N is a positive integer. The timing control circuit includes a receiver and an adjustment circuit. The receiver is configured to sequentially receive first display data and second display data for a data line of the display panel. The adjustment circuit is coupled to the receiver to adjust at least one of gray information of the second display data and charging time of the second display data according to a voltage polarity of the first display data and a voltage polarity of the second display data.

An operation method of a timing control circuit in the disclosure includes the following steps. First display data and second display data for a data line of a display panel are sequentially received by a receiver of the timing control circuit. At least one of gray information of the second display data and charging time of the second display data is adjusted by an adjustment circuit of the timing control circuit according to a voltage polarity of the first display data and a voltage polarity of the second display data. The timing control circuit is configured to control a data voltage outputted to a pixel array of the display panel during a frame period to perform a polarity reversal every N scan lines, where N is a positive integer.

In an embodiment of the disclosure, the adjustment circuit includes an overdriving circuit. The overdriving circuit is configured to adjust the gray information of the second display data with an adjustment value according to the voltage polarity of the first display data, the voltage polarity of the second display data, and a gray-scale difference between gray information of the first display data and the gray information of the second display data, thereby increasing a data voltage corresponding to the second display data.

In an embodiment of the disclosure, the timing control circuit includes a storage circuit. The storage circuit stores multiple candidate adjustment values. The overdriving circuit is further configured to obtain the adjustment value from the candidate adjustment values.

In an embodiment of the disclosure, compared with a case where the voltage polarities of the first display data and the second display data are the same, the overdriving circuit adjusts the gray information of the second display data in a relatively great range when the voltage polarities of the first display data and the second display data are different.

In an embodiment of the disclosure, the timing control circuit includes the storage circuit. The storage circuit stores the candidate adjustment values. The adjustment circuit includes the overdriving circuit. The overdriving circuit is configured to obtain the adjustment value from the candidate adjustment values according to the gray-scale difference between the gray information of the first display data and the gray information of the second display data when the voltage polarity of the second display data is different from the voltage polarity of the first display data. The overdriving circuit is also configured to adjust the gray information of the second display data according to the adjustment value, thereby increasing the data voltage corresponding to the second display data.

In an embodiment of the disclosure, the adjustment circuit includes a charge signal generating circuit. The charge signal generating circuit is configured to generate a pulse signal to instruct a time point when a driving device charges the data line with the second display data. The charge signal generating circuit is further configured to adjust the pulse signal to advance the time point when the voltage polarity of the second display data is different from the voltage polarity of the first display data.

In an embodiment of the disclosure, the adjustment circuit includes a polar signal generating circuit. The polar signal generating circuit is configured to generate a polarity reversal control signal to instruct the voltage polarity of the first display data and the voltage polarity of the second display data.

Based on the above, the timing control circuit in the disclosure may adjust at least one of the gray information and the charging time of the second display data for the case where the polarities of the data voltages of the first display data and the second display data are different. In this way, an issue that multiple pixel rows are not charged enough where the polarity reversal occurs may be solved, and the case where the dark lines appear at the positions corresponding to the above pixel rows on the display panel may be further reduced or avoided.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DETAILED DESCRIPTION OF DISCLOSED EMBODIMENTS

In the disclosure, display operation of a display device is to turn on a charging path of one pixel row at a time according to a vertical scan signal, and a source driver charges all pixels of the pixel row according to a data voltage according to corresponding display data of the pixel. Afterwards, the charging path of the pixel row is turned off, and the charging path of the another pixel row is turned on for charging. The rest may be derived by analog.

Figure 3:
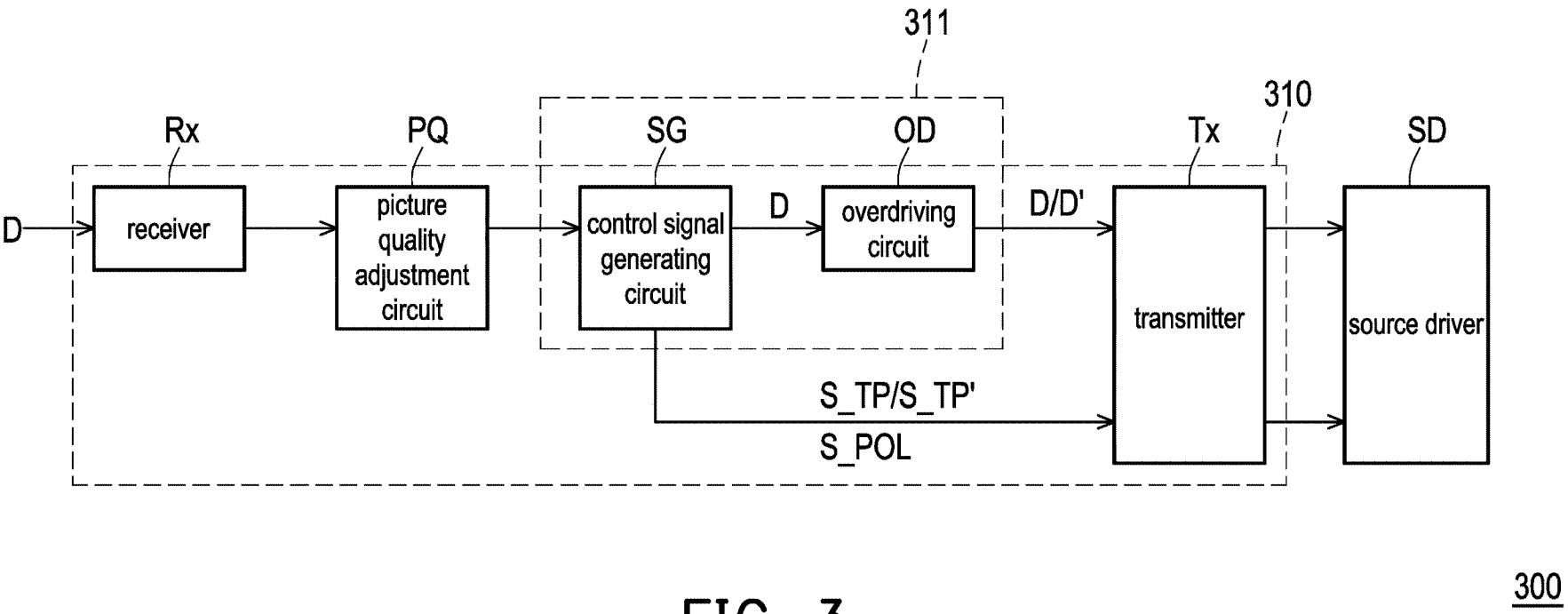
FIG. 3 is a schematic block view of a display device according to an embodiment of the disclosure.

FIG. 3 is a schematic block view of a display device according to an embodiment of the disclosure. Referring to FIG. 3, a display device 300 includes a timing control circuit 310, a source driver SD, and a pixel array (not shown). The pixel array includes multiple pixel rows, and each of the pixel rows includes multiple pixels. The timing control circuit 310 is configured to provide display data and various control signals to the source driver SD. The source driver SD is configured to generate the data voltage according to the received display data and the various control signals to charge the corresponding pixel row (in a turn-on state).

The timing control circuit 310 includes a receiver Rx, a picture quality adjustment circuit PQ, an adjustment circuit 311, and a transmitter Tx. The receiver Rx is configured to receive display data D. The picture quality adjustment circuit PQ is configured to adjust picture quality according to the display data D. The adjustment circuit 311 includes a control signal generating circuit SG and an overdriving circuit OD. The control signal generating circuit SG is configured to generate the various control signals according to the display data D, and provide the various control signals to the source driver SD through the transmitter Tx. The various control signals include a signal S_TP (or S_TP') and a signal S_POL. The overdriving circuit OD is configured to receive the display data D, and provide the display data D (or D') to the source driver SD through the transmitter Tx. The source driver SD includes multiple source driving units configured to drive corresponding pixel columns on a panel.

It should be noted that functions of the receiver Rx, the picture quality adjustment circuit PQ, and the transmitter Tx are familiar to those with ordinary knowledge in the art to which the disclosure pertains. Thus, details in this regard will not be further reiterated in the following. Moreover, the focus of the disclosure is not here. The disclosure aims to improve the control signal generating circuit SG and the overdriving circuit OD, so that functions thereof are different from the past. In the disclosure, the overdriving circuit OD may determine a compensation amount for the current display data D (denoted as the display data D' after compensation) according to the current display data D, the previous display data D, and the signal S_POL. The compensation amount determined when there is a difference between the current display data D and the previous display data D and a voltage polarity is different will be greater than the compensation amount determined when there is a difference between the currently display data D and the previous display data D but the voltage polarity is the same. That is to say, the overdriving circuit OD determines the compensation amount for the current display data D and the corresponding source driving unit thereof, so as to avoid insufficient driving force of the source driving unit, resulting in brightness differences between the adjacent pixel rows.

In addition, the control signal generating circuit SG may further determine whether to adjust a generation time point of at least one pulse of the signal S_TP (denoted as the signal S_TP' after adjustment) according to the signal S_POL. The timing control circuit 310 in the disclosure may adjust at least one of gray information of the current display data and charging time of the current display data in response to the voltage polarity of the current display data being different from the voltage polarity of the previous display data.

Figure 4:
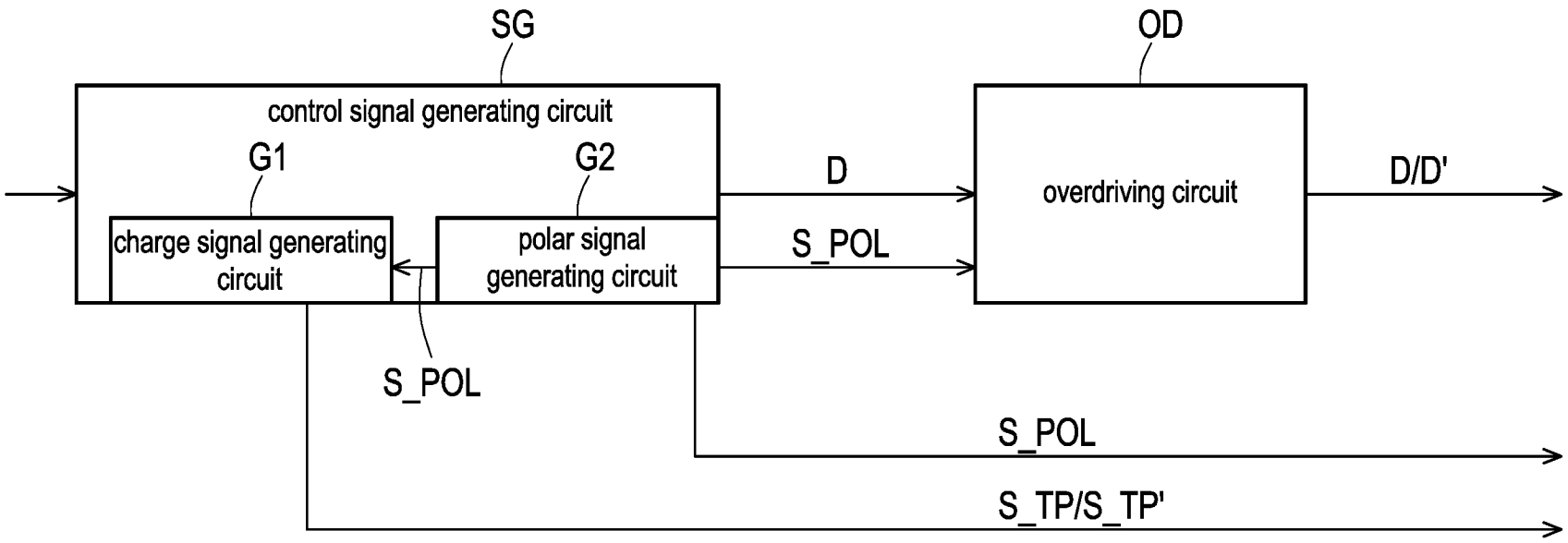
FIG. 4 is a schematic block view of a control signal generating circuit and an overdriving circuit according to an embodiment of the disclosure.

FIG. 4 is a schematic block view of a control signal generating circuit and an overdriving circuit according to an embodiment of the disclosure. Referring to both FIGS. 3 and 4, the control signal generating circuit SG includes a charge signal generating circuit G1 and a polar signal generating circuit G2. The charge signal generating circuit G1 is coupled to the polar signal generating circuit G2 to generate the signal S_TP (or S_TP') according to the signal S_POL. The signal S_TP (or S_TP') is provided to the source driver SD by the transmitter Tx. The source driver SD determines a starting time point for charging multiple data lines according to the signal S_TP (or S_TP'). The polar signal generating circuit G2 is configured to generate the signal S_POL. The signal S_TP is provided to the source driver SD by the transmitter Tx. The source driver SD determines a polarity of the outputted data voltage according to the signal S_POL. The signal S_POL is also provided to the overdriving circuit OD at the same time. The overdriving circuit OD receives the display data D and the signal S_POL. The overdriving circuit OD provides the display data D (or D') to the source driver SD through the transmitter Tx according to the display data D and the signal S_POL. Hereinafter, several embodiments will be used to illustrate the functions of the control signal generating circuit SG and the overdriving circuit OD when a polarity reversal is performed.

Figure 1:
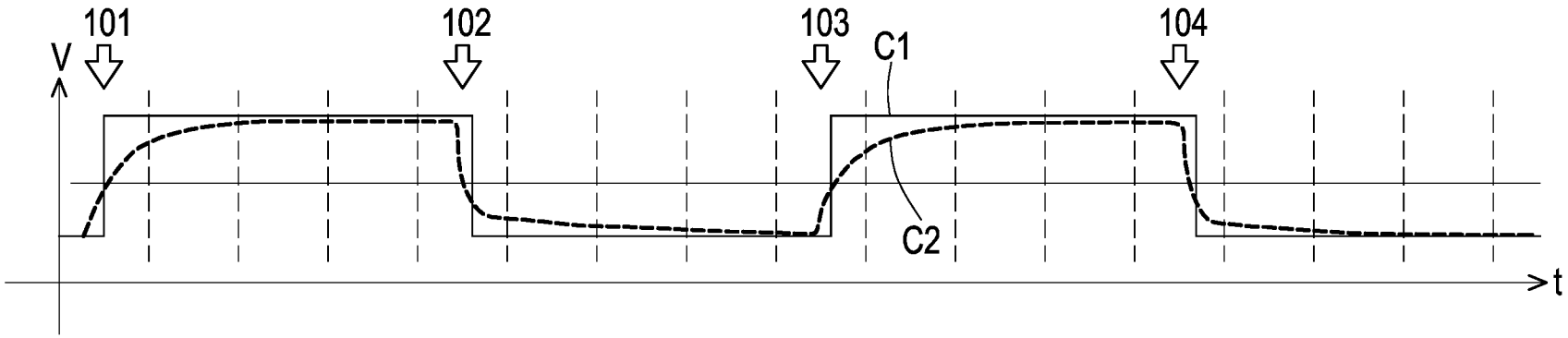
FIG. 1 (Related Art)
FIG. 1 is a schematic view of a waveform of a row inversion performed on a polarity of a data voltage.
Figure 2:
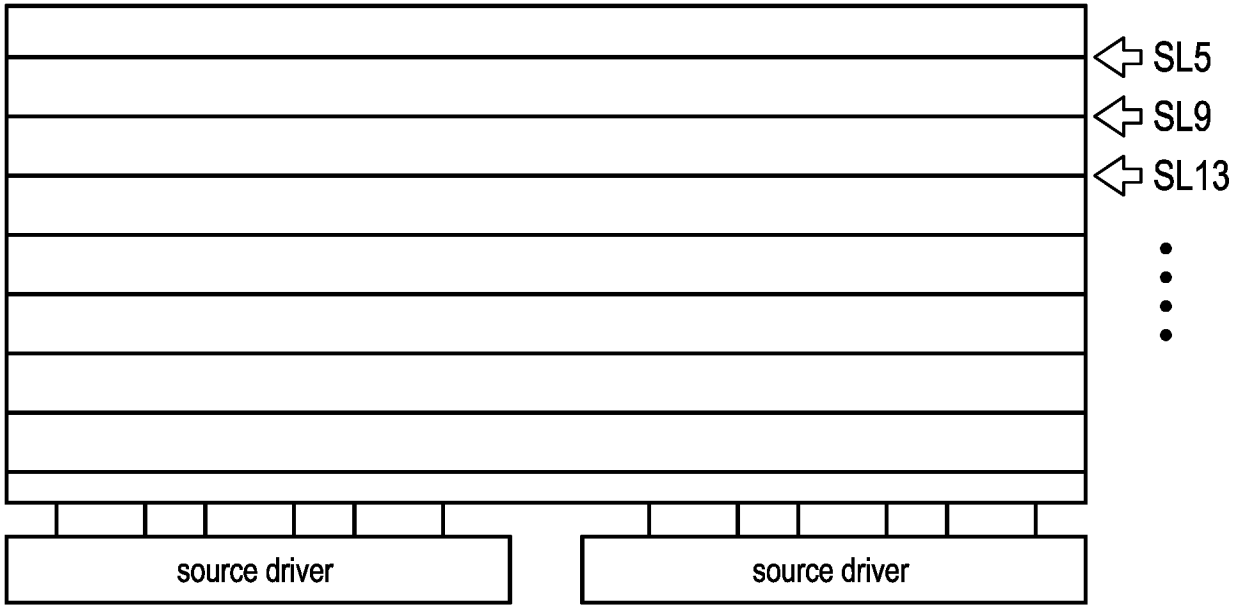
FIG. 2 (Related Art)
FIG. 2 is a schematic view of dark lines appearing on a display screen.
Figure 5:
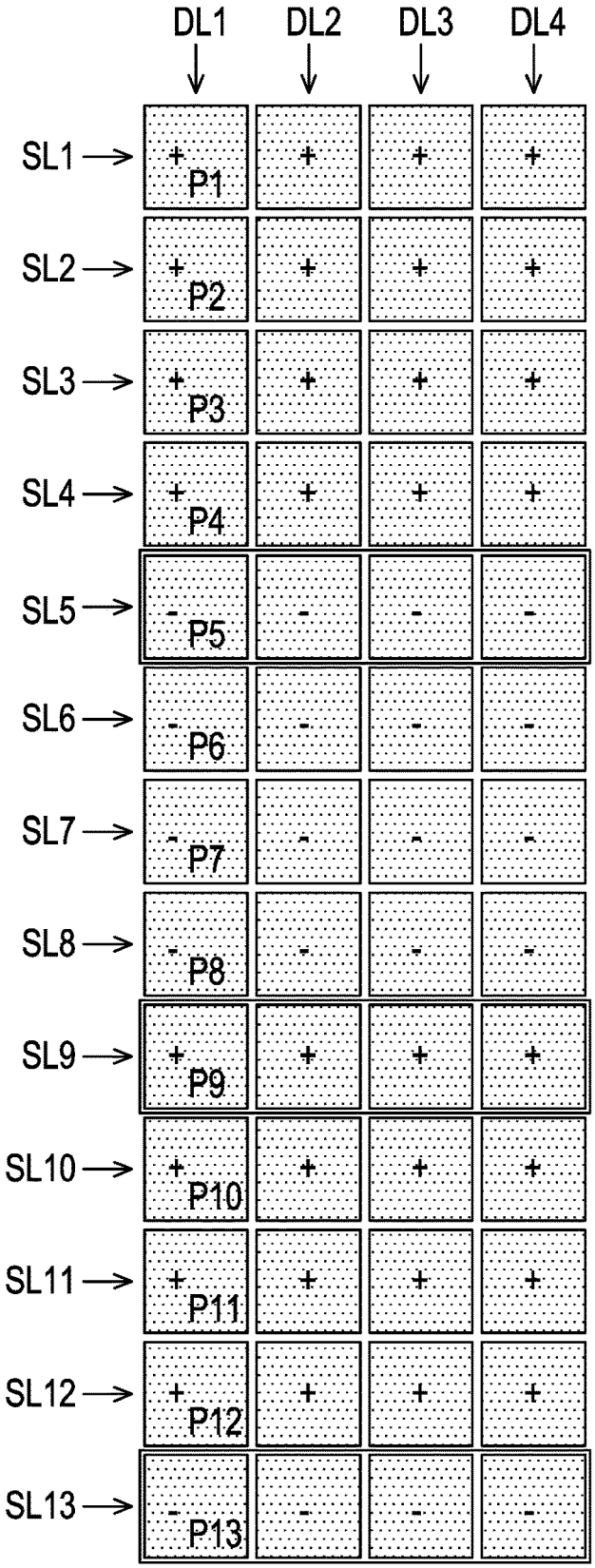
FIG. 5 is a schematic view of a row inversion of polarity of a data voltage received by a pixel array.

FIG. 5 is a schematic view of a row inversion of polarity of a data voltage received by a pixel array. FIG. 5 shows only a part of the pixel array. All the pixels in FIG. 5 have the same gray scale (presented with the same background color), and the only difference is whether the data voltage provided is a positive polarity or a negative polarity. In this embodiment, the polarity reversal is performed every 4 pixel rows. Referring to FIG. 5, pixel rows SL1 to SL13 are sequentially turned on in such a way that only one pixel row is turned on at a time. The source driver charges the pixels of the turned-on pixel row through data lines DL1 to DL4 according to the data voltage. The data voltages provided by the source driver to the pixel rows SL1 to SL4 and SL9 to SL12 are the positive polarity, and the data voltages provided to the pixel rows SL5 to SL8 and SL13 are the negative polarity. It may be seen that the polarities of the data voltages provided to the pixel row SL4 and the pixel row SL5 are different (switched from the positive polarity to the negative polarity). The polarities of the data voltages provided to the pixel row SL8 and the pixel row SL9 are different (switched from the negative polarity to the positive polarity). Due to the polarity switching of the data voltage, the source driver SD may not charge the pixel rows SL5 and SL9 enough, resulting in the dark lines at positions corresponding to the pixel rows SL5 and SL9 on a display screen as shown in FIG. 2.

Referring to both FIGS. 4 and 5, in the first embodiment, only the overdriving circuit OD determines whether to compensate the data voltage according to the signal S_POL, and the charge signal generating circuit G1 outputs the signal S_TP to the source driver as usual. The timing control circuit sequentially receives the multiple display data for each of the data lines of the display panel, and instructs the source driver to drive the pixel array. Taking the data line DL1 as an example, the timing control circuit sequentially receives the multiple display data corresponding to the data line DL1 (assuming that the gray scales are all the same). The source driver charges a pixel p1 with the data voltage that is the positive polarity corresponding to the first display data according to the signal S_TP (in which the pixel row SL1 is turned on). Then, the source driver charges a pixel p2 with the data voltage that is the positive polarity corresponding to the second display data according to the signal S_TP (in which the pixel row SL2 is turned on). Next, the source driver sequentially charges a pixel p3 with the data voltage that is the positive polarity corresponding to the third display data according to the signal S_TP (in which the pixel row SL3 is turned on). Afterwards, the source driver charges a pixel p4 with the data voltage that is the positive polarity corresponding to the fourth display data according to the signal S_TP, and the rest may be derived by analog.

However, the polarities of the data voltages of the fourth display data and the fifth display data are different. Therefore, the overdriving circuit OD of the timing control circuit may perform the following operations. The overdriving circuit OD may compare the gray information and the polarities of the data voltages of the fourth display data and the fifth display data (according to the signal S_TP). The overdriving circuit OD may determine whether to adjust the outputted display data according to a gray-scale difference between the gray information of the fourth display data and the fifth display data, and according to a comparison result of the polarities of the data voltages of the fourth display data and the fifth display data at the same time. In the first embodiment, since the gray information of the fourth display data and the fifth display data are the same, the overdriving circuit OD adjusts the display data D with an adjustment value only according to the comparison result of the polarities of the data voltages (in which the polarities are different), and outputs an adjustment result (i.e., the display data D').

Figure 6A:
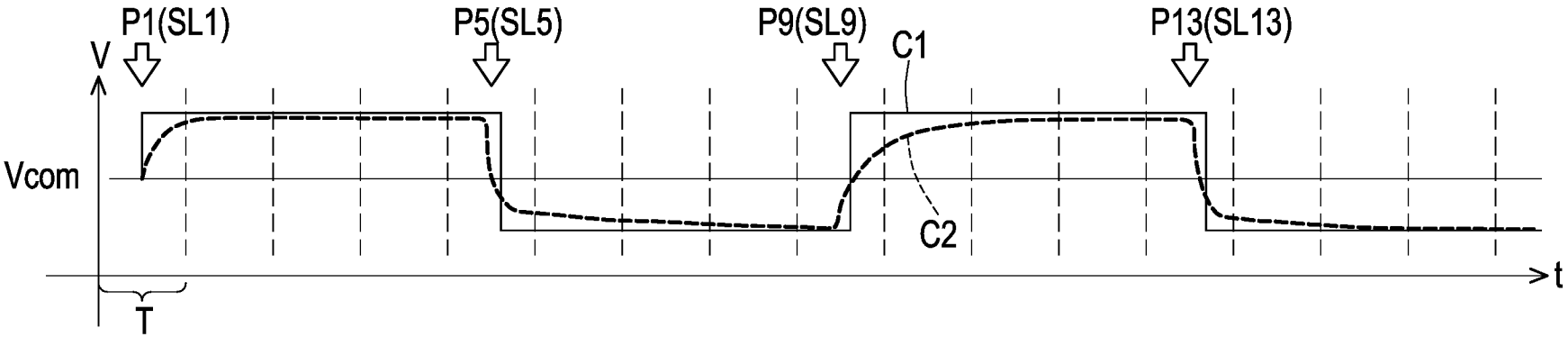
FIG. 6A is a schematic view of a waveform of a row inversion performed on a polarity of a data voltage without using the disclosure.
Figure 6B:
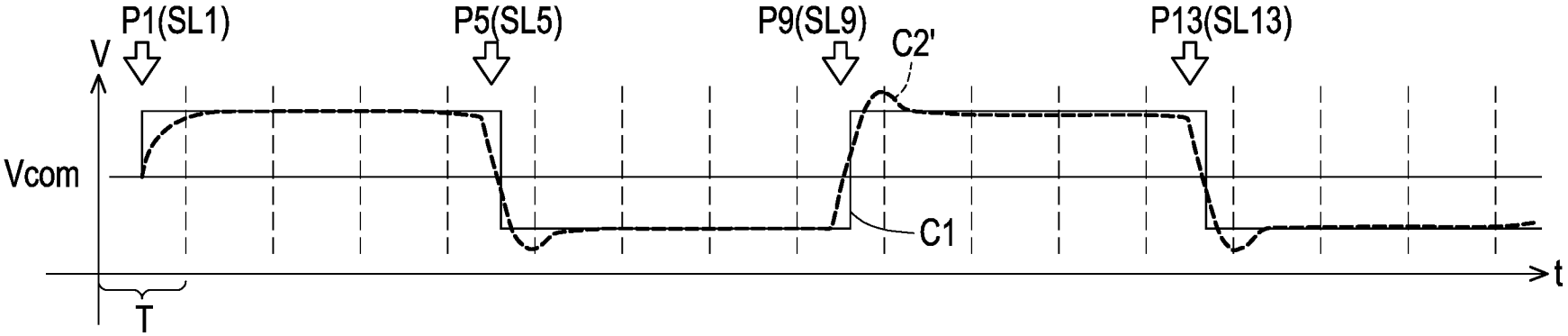
FIG. 6B is a schematic view of a waveform of a row inversion performed on a polarity of a data voltage in the first embodiment of the disclosure.

FIG. 6A is a schematic view of a waveform of a row inversion performed on a polarity of a data voltage without using the disclosure. FIG. 6B is a schematic view of a waveform of a row inversion performed on a polarity of a data voltage in the first embodiment of the disclosure. In FIGS. 6A and 6B, the horizontal axis denotes the time t, and the vertical axis denotes the data voltage V (which may be regarded as the data voltage outputted by the one data channel). The curve C1 denotes the data voltage that varies with time in the ideal state. The curves C2 and C2' both denote the data voltages that vary with time in the actual state. It is assumed that the column polarity inversion is performed every four pixel rows. Vcom denotes a reference voltage, and may also be regarded as an intermediate voltage. T denotes a time interval required to charge the one pixel row.

Referring to both FIGS. 5 and 6A, it may be seen that a pixel p5 is driven by the data voltage that is the negative polarity, but the pixel p4 is driven by the data voltage that is the positive polarity (which is the same for all the pixels in the pixel row SL5). Before the pixel p5 is driven, the overdriving circuit OD may know in advance that the polarity of the data voltage corresponding to the pixel p5 is about to be reversed according to the signal S_TP. Therefore, the overdriving circuit OD may adjust the display data corresponding to the pixel p5 (for example, adjust the gray scale from 128 to 140), so that when the source driver actually drives the pixel p5, the data voltage higher (farther away from the reference voltage Vcom) than the original data voltage is used to drive the pixel p5. Referring to FIGS. 6A and 6B, the pixel p5 in FIG. 6A is not charged enough, so the display screen is darkened at the position corresponding to pixel p5. In fact, it is the same for the entire pixel row SL5, and thus the one dark line appears at the position of the pixel row SL5 on the display screen. In FIG. 6B, since the pixel p5 is driven by the adjusted display data (referring to the display data D' in FIG. 4), a charging condition of the pixel p5 is closer to the ideal state. Similarly, charging conditions of a pixel p9 and a pixel p13 in FIG. 6B are both more ideal than those in FIG. 6A. In other words, an issue of the dark lines at the positions corresponding to the pixel rows SL5, SL9, and SL13 on the display screen may be reduced or avoided.

In an embodiment, the overdriving circuit OD in the disclosure may determine an adjustment range of the second display data through a look up table approach according to a look up table. The look up table may include multiple gray-scale difference information, multiple polarity reversal information (positive to negative or negative to positive), and multiple corresponding candidate adjustment values. The look up table may be pre-stored in a storage circuit, such as a static random access memory (SRAM). The overdriving circuit OD may select the one candidate adjustment value as the adjustment value through the look up table approach, thereby adjusting the second display data (for example, the gray information is adjusted from 128 to 140). Compared with a case where the voltage polarities of the first display data and the second display data are the same, the overdriving circuit OD adjusts the gray information of the second display data in a relatively great range when the voltage polarities of the first display data and the second display data are different.

Referring to both FIGS. 4 and 5, in the second embodiment, only the charge signal generating circuit G1 determines whether to adjust the signal S_TP according to the signal S_POL, and the overdriving circuit OD outputs the display data D to the source driver as usual. Taking the data line DL1 as an example, before the pixels p5, p9, and p13 are actually driven, the charge signal generating circuit G1 may know that the polarity of the data voltage is about to be reversed through the signal S_POL. Specifically, the charge signal generating circuit G1 may compare the data voltage polarities corresponding to the two display data before and after, and determine whether to adjust the signal S_TP according to the comparison result. When the comparison result indicates that the polarity of the data voltage is about to be reversed, the charge signal generating circuit G1 adjusts the signal S_TP to advance charging time of the corresponding pixels p5, p9, and p13.

Figure 7A:
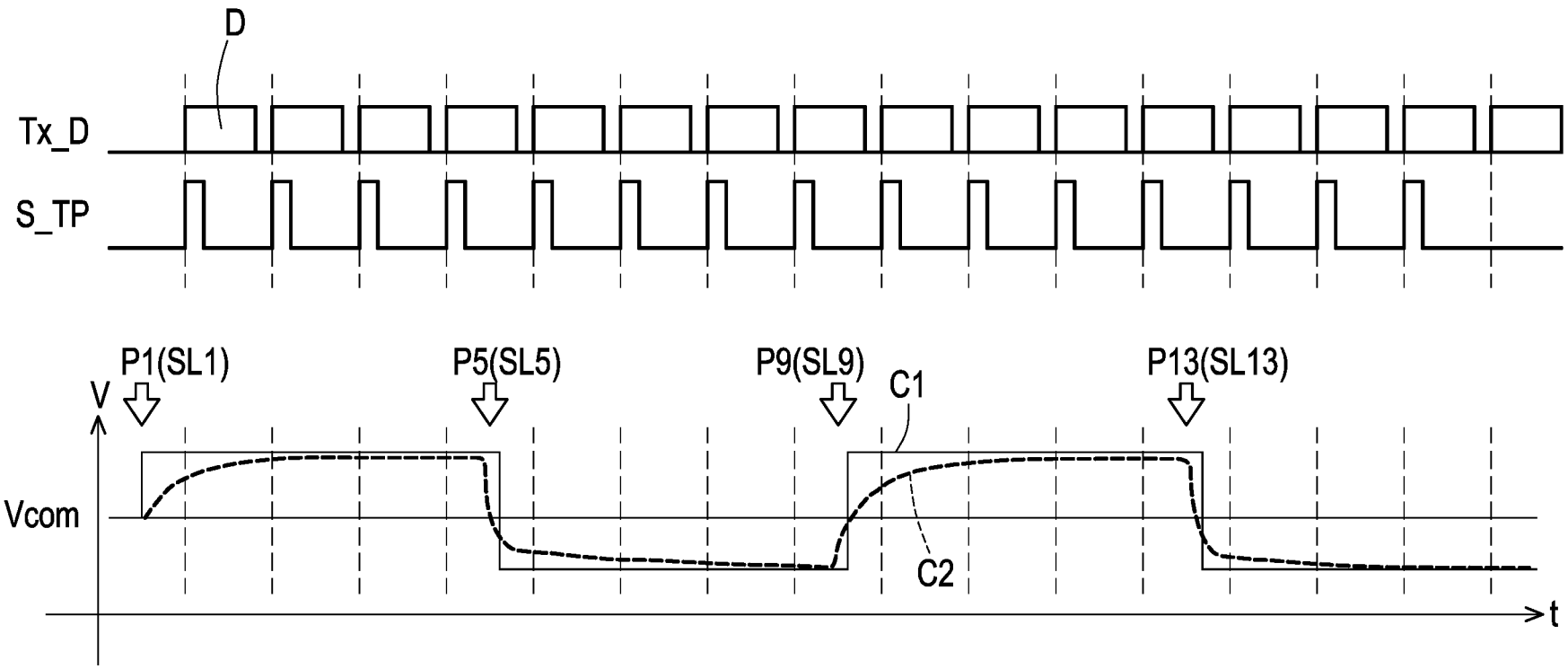
FIG. 7A is a schematic view of a waveform of a row inversion performed on a polarity of a data voltage without using the disclosure.
Figure 7B:
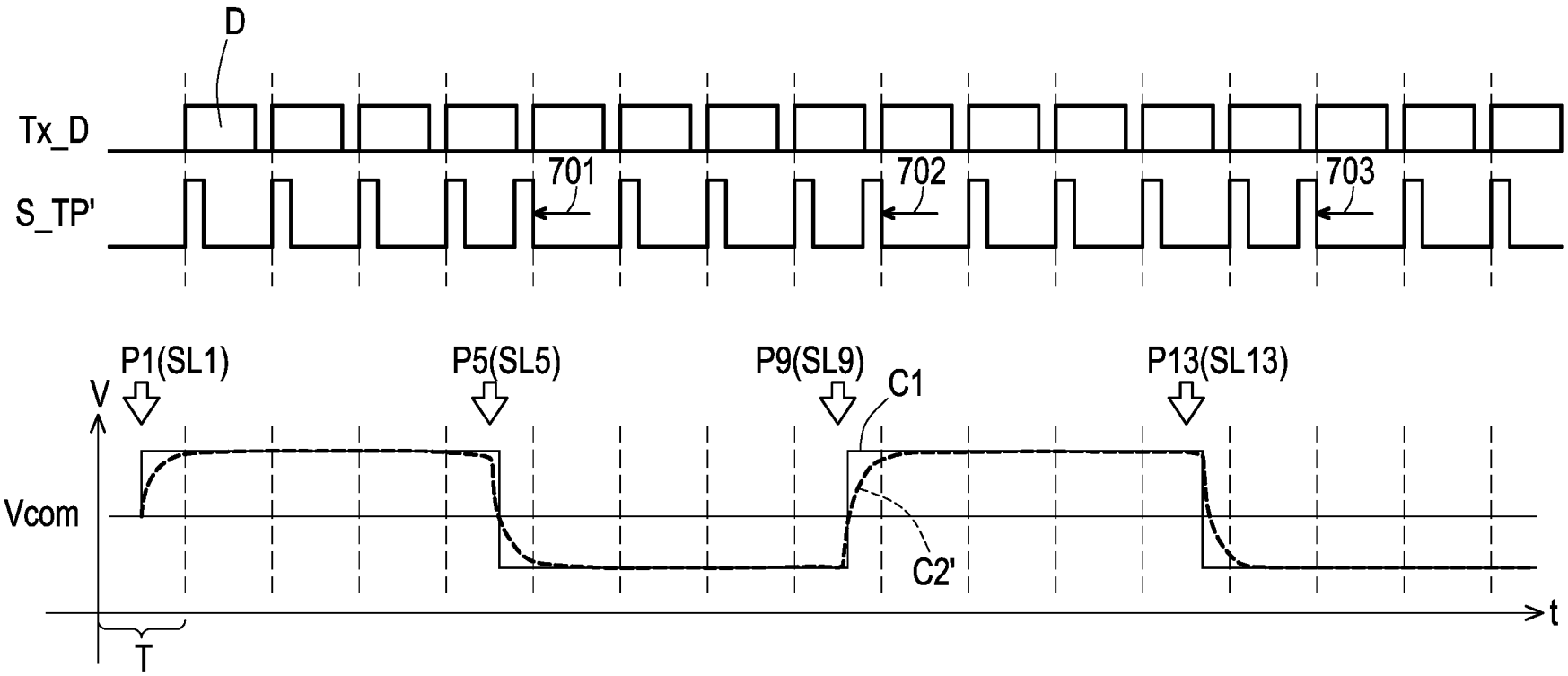
FIG. 7B is a schematic view of a waveform of a row inversion performed on a polarity of a data voltage in the second embodiment of the disclosure.

FIG. 7A is a schematic view of a waveform of a row inversion performed on a polarity of a data voltage without using the disclosure. FIG. 7B is a schematic view of a waveform of a row inversion performed on a polarity of a data voltage in the second embodiment of the disclosure. Similarly, in FIGS. 7A and 7B, the horizontal axis denotes the time t, and the vertical axis denotes the data voltage V (which may be regarded as the data voltage outputted by the one data channel). The curve C1 denotes the data voltage that varies with time in the ideal state. The curves C2 and C2' both denote the data voltages that vary with time in the actual state. The transmitter Tx outputs the display data D according to a signal Tx_D. Vcom denotes the reference voltage, and may also be regarded as the intermediate voltage. T denotes the time interval required to charge the one pixel row.

Referring to both FIGS. 5 and 7A, it may be seen that the pixel p5 is driven by the data voltage that is the negative polarity, but the pixel p4 is driven by the data voltage that is the positive polarity (which is the same for all the pixels in the pixel row SL5). Before the pixel p5 is driven, the charge signal generating circuit G1 may know in advance that the polarity of the data voltage corresponding to the pixel p5 is about to be reversed according to the signal S_TP. Therefore, the charge signal generating circuit G1 may adjust the signal S_TP to advance the time point when the source driver charges the pixel p5. Referring to FIGS. 7A and 7B, the pixel p5 in FIG. 7A is not charged enough, so the display screen is darkened at the position corresponding to pixel p5. In fact, it is the same for the entire pixel row SL5, and thus the one dark line appears at the position of the pixel row SL5 on the display screen. In FIG. 7B, since the pixel p5 is driven earlier, the charging start time point of the pixel p5 is advanced (referring to an arrow 701), the charging condition is relatively ideal (closer to the curve C1 compared with FIG. 7A). A frequency and a position of a rising edge of a signal of the signal Tx_D will not change due to the adoption of the technical solution in the disclosure. Similarly, the charging start time point of the pixel p9 and the pixel p13 is advanced (referring to arrows 702 and 703). Therefore, the charging conditions of the pixel p9 and the pixel p13 in FIG. 7B are both more ideal than those in FIG. 7A. In this way, the dark lines at the positions corresponding to the pixel rows SL5, SL9, and SL13 on the display screen may be reduced or avoided.

Referring to both FIGS. 4 and 5, in the third embodiment, the overdriving circuit OD determines whether to compensate the data voltage according to the signal S_POL, and the charge signal generating circuit G1 also determines whether to adjust the signal S_TP according to the signal S_POL. Taking the pixel p5 of the pixel row SL5 as an example, the display data corresponding to the pixel p5 may be adjusted according to the comparison result of the polarities of the data voltages, and the charging start time point of the pixel p5 may also be advanced according to the comparison result of the polarities of the data voltages. As a result, the issue of the dark lines at the positions corresponding to the pixel rows SL5, SL9, and SL13 on the display screen may be reduced or avoided.

Figure 8:
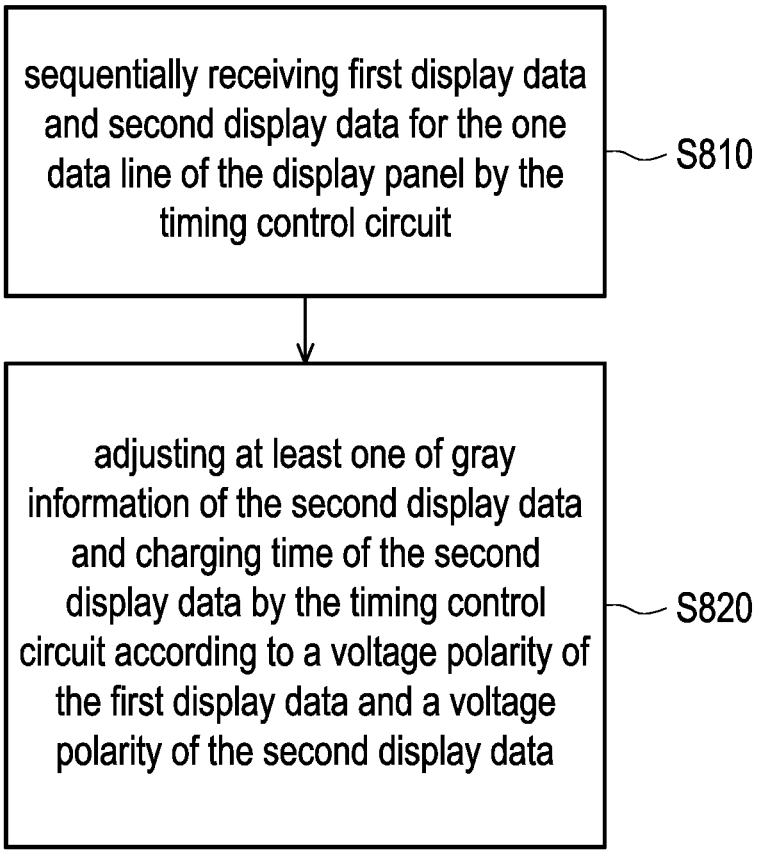
FIG. 8 is a flowchart of steps of an operation method of a timing control circuit according to an embodiment of the disclosure.

FIG. 8 is a flowchart of steps of an operation method of a timing control circuit according to an embodiment of the disclosure. Referring to both FIGS. 3 and 8, in step S810, the timing control circuit 310 sequentially receives the first display data and the second display data for the one data line of the display panel. In step S820, the timing control circuit 310 adjusts at least one of the gray information of the second display data and the charging time of the second display data according to the voltage polarity of the first display data and the voltage polarity of the second display data.

It should be noted that the above embodiments are described based on a case where the polarity reversal is performed once every 4 rows, but the disclosure is not limited thereto. The disclosure may also be applied to a case where the polarity reversal is performed on any number of rows. For example, the polarity reversal is performed every 2 rows or every 8 rows. In addition, the above embodiments are described in the case of the row inversion of polarity, but the disclosure may also be applied to the case of dot inversion. To put it simply, the disclosure may be adopted as long as the single data channel undergoes the polarity reversal during a frame period.

Based on the above, the timing control circuit in the disclosure may adjust at least one of the gray information and the charging time of the current display data for the case where the polarities of the data voltages of the previous display data and the current display data are different. In this way, the issue that the pixel rows are not charged enough where the polarity reversal occurs may be solved, and the case where the dark lines appear at the positions corresponding to the above pixel rows on the display panel may be further reduced or avoided.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A timing control circuit, comprising:

a receiver sequentially receiving first display data and second display data for a data line of the display panel; and an adjustment circuit coupled to the receiver to adjust at least one of gray information of the second display data and charging time of the second display data in response to a voltage polarity of the first display data being different from a voltage polarity of the second display data, wherein the adjustment circuit comprises:

an overdriving circuit to adjust the gray information of the second display data with an adjustment value according to the voltage polarity of the first display data, the voltage polarity of the second display data, and a gray-scale difference between gray information of the first display data and the gray information of the second display data, thereby increasing a data voltage corresponding to the second display data.

2. The timing control circuit according to claim 1, wherein the timing control circuit includes a storage circuit, the storage circuit stores a plurality of candidate adjustment values, and the overdriving circuit obtains the adjustment value from the candidate adjustment values.

3. The timing control circuit according to claim 1, wherein compared with a case where the voltage polarities of the first display data and the second display data are the same, the overdriving circuit adjusts the gray information of the second display data in a relatively great range when the voltage polarities of the first display data and the second display data are different.

4. The timing control circuit according to claim 1, wherein the adjustment circuit further comprises:

a charge signal generating circuit to generate a pulse signal to instruct a time point when a driving device charges the data line with the second display data, wherein the charge signal generating circuit is further adjusts the pulse signal to advance the time point when the voltage polarity of the second display data is different from the voltage polarity of the first display data.

5. The timing control circuit according to claim 1, wherein the adjustment circuit further comprises:

a polar signal generating circuit to generate a polarity reversal control signal to instruct the voltage polarity of the first display data and the voltage polarity of the second display data.

6. A timing control circuit, comprising:

a receiver sequentially receiving first display data and second display data for a data line of the display panel; and an adjustment circuit coupled to the receiver to adjust at least one of gray information of the second display data and charging time of the second display data in response to a voltage polarity of the first display data being different from a voltage polarity of the second display data, wherein the timing control circuit comprises a storage circuit, the storage circuit stores a plurality of candidate adjustment values, and the adjustment circuit further comprises:

an overdriving circuit to obtain an adjustment value from the candidate adjustment values according to a gray-scale difference between gray information of the first display data and the gray information of the second display data when the voltage polarity of the second display data is different from the voltage polarity of the first display data, wherein the overdriving circuit adjusts the gray information of the second display data according to the adjustment value, thereby increasing a data voltage corresponding to the second display data.

7. A operation method of a timing control circuit, comprising:

sequentially receiving first display data and second display data for a data line of the display panel by a receiver of the timing control circuit; and adjusting at least one of gray information of the second display data and charging time of the second display data by an adjustment circuit of the timing control circuit in response to a voltage polarity of the first display data being different from a voltage polarity of the second display data, wherein the adjustment circuit comprises an overdriving circuit, and the operation method further comprises:

adjusting the gray information of the second display data with an adjustment value by the overdriving circuit according to the voltage polarity of the first display data, the voltage polarity of the second display data, and a gray-scale difference between gray information of the first display data and the gray information of the second display data, thereby increasing a data voltage corresponding to the second display data.

8. The operation method of the timing control circuit according to claim 7, wherein the timing control circuit comprises a storage circuit, the storage circuit stores a plurality of candidate adjustment values, and the operation method further comprises:

obtaining the adjustment value from the candidate adjustment values by the overdriving circuit.

9. The operation method of the timing control circuit according to claim 7, wherein compared with a case where the voltage polarities of the first display data and the second display data are the same, adjusting the gray information of the second display data in a relatively great range by the overdriving circuit when the voltage polarities of the first display data and the second display data are different.

10. The operation method of the timing control circuit according to claim 7, wherein the adjustment circuit comprises a charge signal generating circuit, and the operation method further comprises:

generating a pulse signal by the charge signal generating circuit to instruct a time point when a driving device charges the data line with the second display data; and adjusting the pulse signal by the charge signal generating circuit to advance the time point when the voltage polarity of the second display data is different from the voltage polarity of the first display data.

11. The operation method of the timing control circuit according to claim 7, wherein the adjustment circuit comprises a polar signal generating circuit, and the operation method further comprises:

generating a polarity reversal control signal by the polar signal generating circuit to instruct the voltage polarity of the first display data and the voltage polarity of the second display data.

12. A operation method of a timing control circuit, comprising:

sequentially receiving first display data and second display data for a data line of the display panel by a receiver of the timing control circuit; and adjusting at least one of gray information of the second display data and charging time of the second display data by an adjustment circuit of the timing control circuit in response to a voltage polarity of the first display data being different from a voltage polarity of the second display data, wherein the timing control circuit comprises a storage circuit, the storage circuit stores a plurality of candidate adjustment values, the adjustment circuit comprises an overdriving circuit, and the operation method further comprises:

obtaining an adjustment value from the candidate adjustment values by the overdriving circuit according to a gray-scale difference between gray information of the first display data and the gray information of the second display data when the voltage polarity of the second display data is different from the voltage polarity of the first display data; and adjusting the gray information of the second display data by the overdriving circuit according to the adjustment value, thereby increasing a data voltage corresponding to the second display data.

* * * * *